US007828677B2

(12) United States Patent
Steinhobel

(10) Patent No.: US 7,828,677 B2
(45) **Date of Patent: *Nov. 9, 2010**

(54) DRIVING RANGE GOLF TEE

(75) Inventor: Brian Steinhobel, Sandton (ZA)

(73) Assignee: Bonfit America, Inc., Culver City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/351,743

(22) Filed: Jan. 9, 2009

(65) Prior Publication Data

US 2010/0179004 A1 Jul. 15, 2010

(51) Int. Cl.
*A63B 57/00* (2006.01)

(52) U.S. Cl. ..... 473/387

(58) Field of Classification Search ..... 473/387–403; D21/717, 718

See application file for complete search history.

(56) References Cited

U.S. PATENT DOCUMENTS

| | | | | |
|---|---|---|---|---|
| 4,905,999 | A | 3/1990 | Voinovich et al. | |
| 5,156,403 | A | 10/1992 | Martino | |
| 5,248,144 | A | 9/1993 | Ullerich | |
| 5,301,950 | A * | 4/1994 | Patterson | 473/287 |
| D369,845 | S * | 5/1996 | Knez | D21/718 |
| 5,728,013 | A | 3/1998 | Luther, Sr. | |
| 6,482,111 | B1 | 11/2002 | Jofferion | |
| D479,296 | S * | 9/2003 | McCall | D21/789 |
| D491,619 | S * | 6/2004 | Crouse | D21/718 |
| D518,537 | S * | 4/2006 | Lee et al. | D21/717 |
| 7,052,416 | B2 | 5/2006 | Chang | |
| D566,801 | S * | 4/2008 | Grant | D21/717 |
| 7,384,353 | B2 | 6/2008 | Lipidarov | |
| 7,458,906 | B2 | 12/2008 | Choe | |
| D604,375 | S * | 11/2009 | Steinhobel | D21/717 |
| 2004/0185967 | A1 * | 9/2004 | McDonough et al. | 473/387 |
| 2005/0181893 | A1 * | 8/2005 | Slaven | 473/387 |
| 2006/0205537 | A1 * | 9/2006 | Kiah | 473/387 |
| 2006/0287135 | A1 * | 12/2006 | Pommereau | 473/387 |
| 2007/0149324 | A1 * | 6/2007 | Tsai | 473/387 |

* cited by examiner

*Primary Examiner*—Steven Wong
(74) *Attorney, Agent, or Firm*—Connolly Bove Lodge & Hutz LLP; Billy A. Robbins

(57) ABSTRACT

A molded plastic unitary driving range golf tee which has an outwardly extending flange at its base with a tubular member centrally disposed thereon and extending therefrom. The tubular member terminates at a rim and a plurality of discrete flexible fingers extend upwardly from the rim and terminate in distal ends which support a golf ball. The molded plastic tee is adapted to be received in an opening provided in a typical driving range mat with the discrete flexible fingers extending above the surface of the mat.

5 Claims, 2 Drawing Sheets

DRIVING RANGE GOLF TEE

BACKGROUND OF THE INVENTION

1. Field of the Invention

The present invention relates to a golf accessory, and more particularly to a driving range golf tee which is adapted to be inserted into the opening in the typical mats used on driving ranges and which is adapted to simulate a soft lie of the type present when a golf ball rests on grass.

2. Description of Prior Art

In order to improve their games golfers practice as often as possible. In practice most golfers go to a driving range. Many driving ranges use mats instead of growing grass for the simple reason to maintain the maintenance costs as low as possible. When utilizing a mat and particularly when utilizing woods a rubber tee is inserted through an opening in the mat such that when the golfer wishes to tee up the ball he/she is able to place the golf ball on the rubber tee. The rubber tees used in the prior art are cylindrical members which extend through the opening in the mat for a desired distance above the top of the mat to allow the golfer to use the club he/she desires. One disadvantage of the prior art cylindrical rubber tube used with the mats on the driving ranges is that it is rather stiff and applies undesirable spin to the golf ball when struck by the golf club as a result of the physical contact between the tee and the golf ball. In addition, when the golfer strikes the ball positioned upon the rubber tee the feeling at impact is totally different from the feeling the golfer obtains when striking the ball during the normal play of the game. One of the desirable features in practice is that the golfer hits the shots which are as nearly the same as they would be on a golf course as is possible.

Most mats used on driving ranges are approximately 1 inch in thickness and therefore the rubber tees that are used are typically at least 1½ inches long. They vary in length with existing rubber tees ranging from 1½ inches to 3 inches long depending on how high the golfer wants to tee up the ball. With the introduction of oversized titanium drivers the longer tees are required. USGA conforming drivers can be as big as 460 cc in volume, however, some nonconforming models are even bigger. However, many golfers prefer drivers that are smaller in size. This creates a situation where the golfer needs to find a tee having the desired length depending upon the club which is to be used. On typical driving ranges the variation in the height of tees is difficult to obtain and thus the golfer must practice utilizing the undesirable rubber tee at an undesirable height above the top of the mat.

There is thus a need in the golf industry for a tee which can be used with the traditional mats used on driving ranges which will provide the desirable feel to the golfer at the time the golf ball is struck and which will also provide minimum contact between the tee and the golf ball to minimize improper spin being imparted to the golf ball as a result of contact with the tee and/or the wind generated by the face of the golf club as it moves into the impact zone adjacent the golf ball.

SUMMARY OF INVENTION

The present invention is a driving range golf tee which includes a base having a radially outwardly extending flange. A tubular member centrally disposed on the base extends upwardly from the base and has a length generally equivalent to the thickness of the mat and the tubular member also includes a rim. A plurality of discrete flexible fingers extend upwardly from the rim above the mat and include distal ends which support a golf ball.

DETAILED DESCRIPTION

The present invention provides a driving range golf tee which includes a plurality of flexible fingers constructed of molded flexible plastic material with the flexible fingers adapted at their distal ends to support a golf ball. The flexible fingers are discrete and spaced apart and provide openings through which the wind generated by the golf club as it approaches the impact zone may pass so as to not disturb the proper rotation of the golf ball. By being supported on the distal ends of the flexible fingers the driving range golf tee does not impart undesirable spin characteristics to the ball as a result of the contact between the ball and the tee. The fingers are an extension of a base having a tubular portion extending therefrom which extends through the driving range mat opening with the tubular member remaining inside the opening in the mat but with the flexible fingers extending above the surface of the mat to the height desired by the golfer in conducting his/her practice session depending upon the particular club being used. The molded flexible plastic fingers move forward in the direction of the swing when struck by the golf club and by being flexible provide a soft feel to the golfer similar to that which is accomplished when the golfer strikes the golf ball on the golf course from a grass lie.

Figure 1:
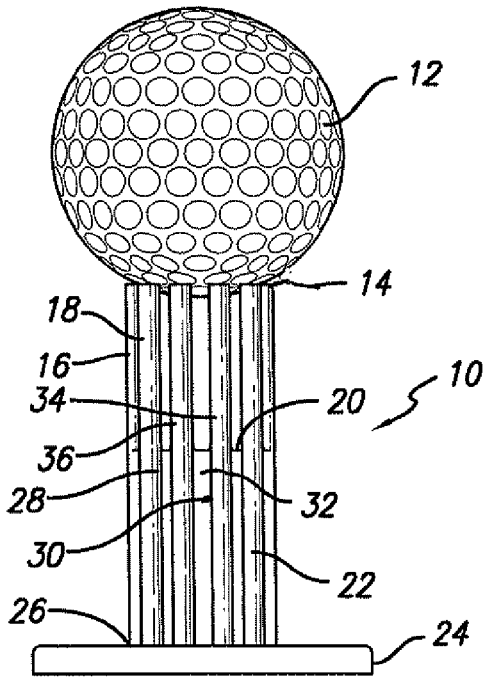
FIG. 1 is a front view of a driving range golf tee constructed in accordance with the present invention with a golf ball supported thereon.

Referring more particularly to FIG. 1, there is illustrated in front elevational view a golf tee adapted for use on a driving range and constructed in accordance with the principles of the present invention. The golf tee 10 as shown in FIG. 1 supports a golf ball 12 on the tips 14 of a plurality of fingers such as shown at 16 and 18 which extend upwardly from a rim 20 which is formed on top of a tubular member 22 which is received within the aperture formed in the typical mat used on driving ranges for practice. An outwardly extending flange shaped member 24 extends from the base 26 of the tubular member 22 and extends outwardly at the bottom of the mat to hold the tee 10 in place during a practice session. As is illustrated the tubular member 22 has a plurality of ribs such as shown at 28 and 30 along the outer surface 32 thereof. The fingers 16 and 18 which are discretely placed on the rim 20 are continuations of the ribs 28 and 30. As is shown at 34 and 36, the discrete fingers 16 and 18 taper inwardly slightly from the rim 20 toward the distal ends 14 thereof. Such inward tapering allows the molded plastic tee 10 to be ejected from the mold at the completion of the molding process. It will be understood by those skilled in the art that the tee 10 is a unitary molded plastic member. Although, various material may be utilized to form the tee 10, in accordance with a preferred embodiment of the present invention the tee is formed from polyurethane plastic material having a hardness of between 60 and 90 durometer measured on the Shore scale A.

Figure 2A:
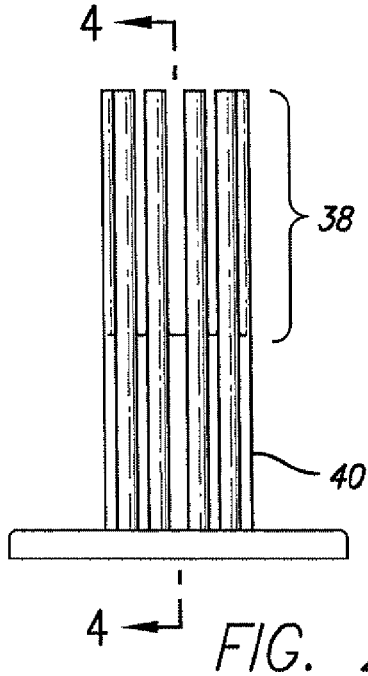
FIGS. 2*a*-2*c* illustrate a tee as shown in FIG. 1 in different heights.
Figure 2B:
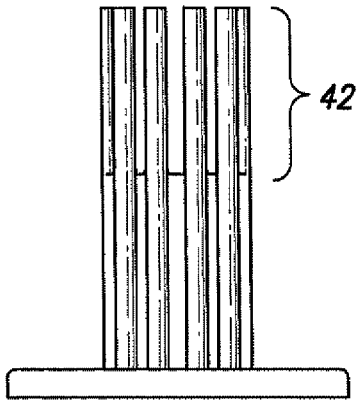
Figure 2C:
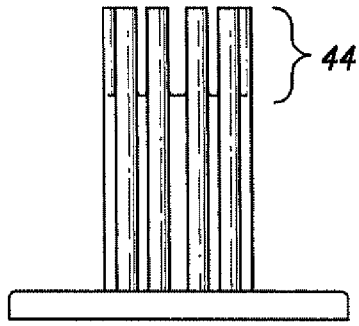

As shown in FIGS. 2*a*-2*c*, a tee of the present invention is constructed such that the discrete fingers may have different heights depending upon the club which the golfer desires to use during practice. For example, as shown in FIG. 2*a* the fingers have a height 38 above the tubular member 40 which would be useful for an oversized driver on the order of 460 cc volume as above described. The tee as shown in FIG. 2*b* would have a height of the discrete fingers as shown at 42 which would be useful with a driver having smaller volumetric size as is desired by some golfers. The tee shown in FIG. 2*c* would have discrete fingers having a height shown at 44 which would be useful in practicing with a fairway wood or a typical hybrid club. Thus, it should be recognized that the driving range tee constructed in accordance with the principles of the present invention may have heights which vary and can have any desired dimension of the discrete fingers to accommodate the practice desires of the golfer.

Figure 3:
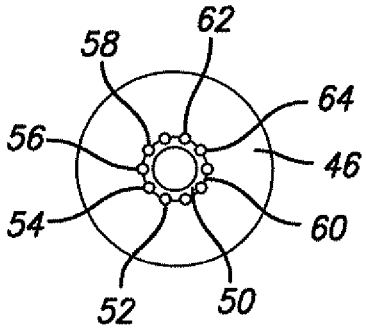
FIG. 3 is a top plan view of the golf tee illustrated in FIG. 2*a;*

Referring now more particularly to FIG. 3, there is shown a top plan view of the driving range golf tee as illustrated in FIG. 2*a*. As is therein shown the outwardly extending flange 46 has the upwardly extending tubular member 48 centrally disposed on the flange 46 and terminating in a rim 50. A plurality of ridges or ribs such as shown at 52, 54, 56 and 58 are disposed on the outer surface 60 of the upwardly extending tubular member 48. These ridges or ribs form the base for the upwardly extending discrete fingers as shown at 62 and 64 (FIG. 4).

Figure 4:
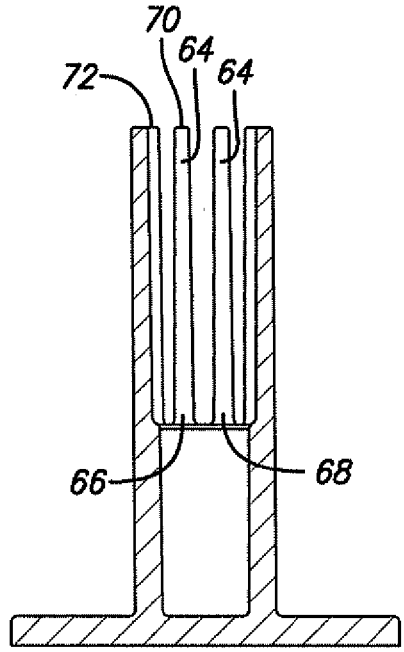
FIG. 4 is a cross-sectional view taken about the lines 4-4 of FIG. 2*a;*

As shown in FIG. 4 which is a cross-sectional view of the tee taken about the lines 4-4 of FIG. 2*a*, the discrete fingers such as shown at 62 and 64 taper from the base thereof as shown at 66 and 68 adjacent the rim 50 so that they taper inwardly as they progress to the distal ends 70 and 72 thereof. The distal ends then support the golf ball as shown in FIG. 1 only at the distal ends of the fingers. As above indicated the tee is a unitary molded plastic tee such that the discrete fingers are flexible and will provide a soft lie feel to the golfer during the practice session. The unitary molded plastic tee as above indicated is preferably made from polyurethane plastic material. For tees which are relatively short such as shown in FIG. 2*c*, the durometer hardness of the material is on the order of 60 on the Shore scale A and for a longer tee as shown in FIG. 2*a* the polyurethane plastic material has a hardness of approximately 90 durometer as measured on the Shore scale A. For tees having an intermediate length such as shown in FIG. 2*b*, the hardness of the plastic material would be between 60 and 90 durometer such for example as approximately 75.

Figure 5:
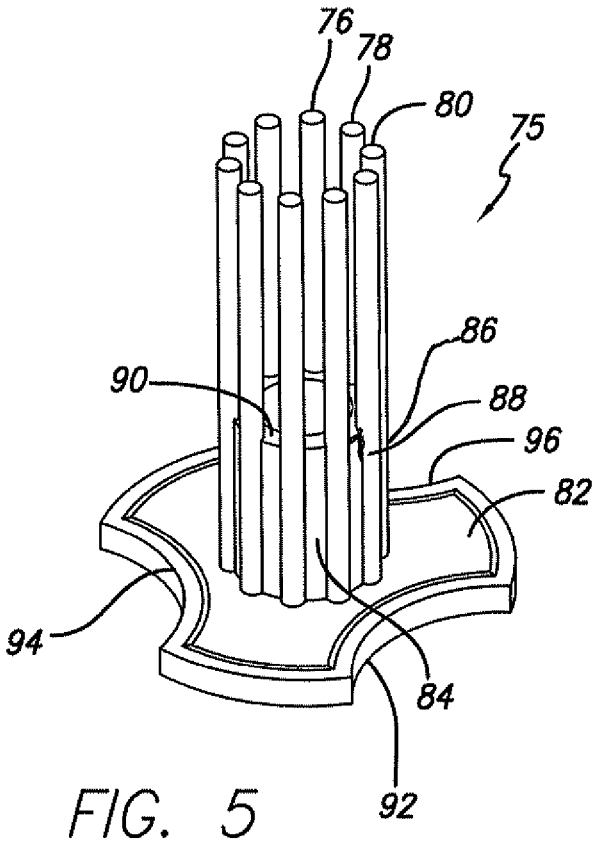
FIG. 5 is a perspective view of an alternative embodiment of a driving range golf tee constructed in accordance with the principles of the present invention.
Figure 6:
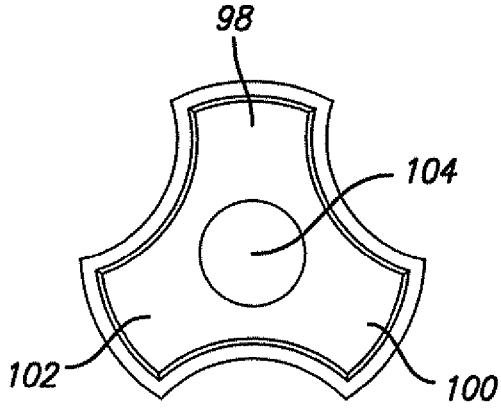
FIG. 6 is a bottom view of the driving range golf tee illustrated in FIG. 5.

Referring more particularly to FIGS. 5 and 6, there is illustrated an alternative embodiment of a driving range golf tee constructed in accordance with the principles of the present invention. The golf tee 75 shown in FIG. 5 is a unitary molded plastic tee preferably formed from polyurethane plastic having a hardness between 60 and 90 durometer measured on the Shore scale A depending upon the length of the discrete fingers as shown for example at 76, 78 and 80. As above indicated the longer the fingers 76-80 the hardness would be higher and for example, approach 90 durometer as measured on the Shore scale A whereas if they were shorter they would be on the order of 60 durometer. The tee 75 has an outwardly extending base 82 having a centrally disposed tubular member 84 extending upwardly therefrom. The tubular member 84 includes a plurality of ribs as shown at 86 and 88 on the outer surface thereof with the discrete fingers as shown at 76-80 continuing therefrom and extending above the rim 90 at the top of the tubular member 84. As is illustrated, the base 82 has a plurality of cut outs such as shown 92, 94 and 96 thus giving the appearance of a plurality of petal shaped members 98, 100 and 102 extending outwardly therefrom. As is also shown in FIG. 6, the central portion of the base 82 may be eliminated. The openings 104, as well as the cut outs 92, 94 and 96 are provided to reduce the amount of plastic which is contained within the molded plastic tee 75. The molded plastic tee 75 functions in precisely the same manner as above described with respect to the tee as shown in FIGS. 1-4.

There has thus been disclosed a driving range golf tee constructed of a unitary molded polyurethane plastic member having a plurality of discrete flexible fingers adapted to support a golf ball at their distal ends with the fingers extending above the surface of a typical driving range mat so as to provide a soft lie feel to the golfer during a practice session.

What is claimed is:

1. A driving range golf tee for use with a mat having a thickness dimension comprising:

(A) a base including a radially outwardly extending flange;

(B) a tubular member centrally disposed, extending upwardly from said base and having an outer surface and a length generally equivalent to the thickness of said mat and having a rim;

(C) said outer surface of said tubular member defining a plurality of outwardly extending ribs; and (D) a plurality of discrete flexible fingers extending upwardly from said rim above said mat and having distal ends to support a golf ball, said discrete fingers being a continuation of the outwardly extending ribs.

2. A driving range golf tee as defined in claim 1 wherein each of said fingers is tapered inwardly from said rim toward said distal ends.

3. A driving range golf tee as defined in claim 2 wherein said tubular member is a right circular cylinder and said fingers are equiangularly disposed about said rim.

4. A driving range golf tee as defined in claim 3 wherein said flange includes a plurality of petal shaped members extending from said cylinder.

5. A driving range golf tee as defined in claim 1 wherein said tee is a unitary molded polyurethane plastic member having a hardness of between 60 and 90 durometer measured on the Shore scale A.

* * * * *